United States Patent [19]

Reiersdal

[11] 4,103,591

[45] Aug. 1, 1978

[54] DEVICE FOR A HYDRAULICALLY DRIVEN PERCUSSION HAMMER

[76] Inventor: Olav L. Reiersdal, Sandvatn st., 4480 Kvinesdal, Norway

[21] Appl. No.: 719,011

[22] Filed: Aug. 30, 1976

[51] Int. Cl.[2] ..... F15B 15/17; F15B 21/02

[52] U.S. Cl. ..... 91/417 R; 91/39; 91/470; 92/134

[58] Field of Search ..... 91/321, 235, 417 R, 91/39, 165; 92/134

[56] References Cited

U.S. PATENT DOCUMENTS

| | | | |
|---|---|---|---|
| 2,408,338 | 9/1946 | Parsons | 91/417 R |
| 3,587,394 | 6/1971 | Hilbrands | 91/417 R |
| 3,766,830 | 10/1973 | Montabert | 91/321 |
| 3,774,502 | 11/1973 | Arndt | 91/321 |

*Primary Examiner*—Paul E. Maslousky
*Attorney, Agent, or Firm*—Ladas, Parry, Von Gehr, Goldsmith & Deschamps

[57] ABSTRACT

Device for a hydraulically driven percussion hammer for activating a tool, comprising a differential piston with corresponding cylinder, where the piston's largest surface is closest to the percussion tool, and where the smallest working surface is in direct hydraulic connection with an air tank. The largest working surface is above a multiple valve in connection with a hydraulic pressure medium. The valve is adjustable from an admission position with closed return duct to a position where the admission is blocked and the return duct is open. The piston chamber above the piston's small working surface has a feed duct with back pressure valve for a hydraulic pressure medium.

4 Claims, 1 Drawing Figure

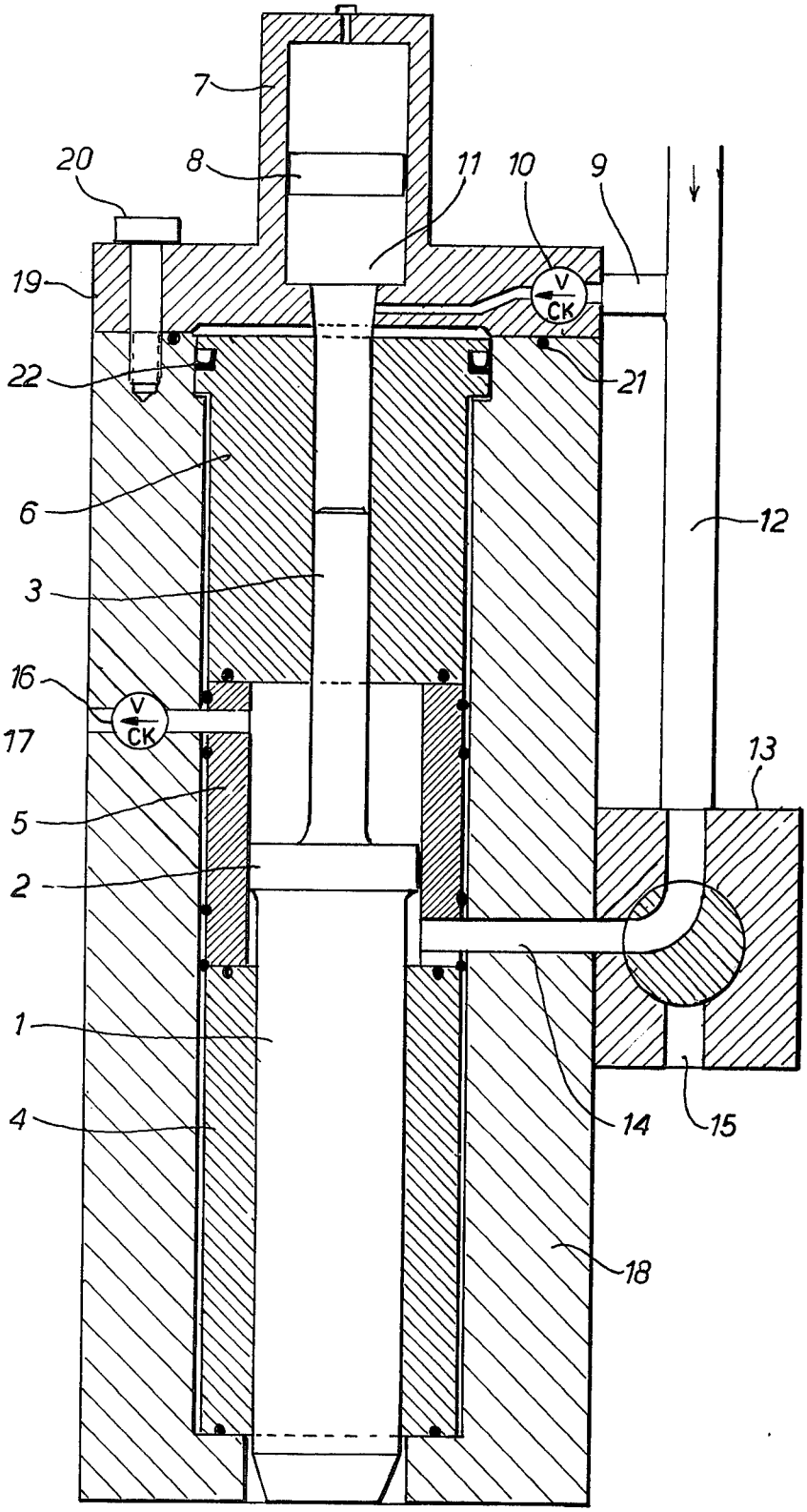
7
20
8
11
10
9
19
V
CK
22
21
6
12
3
16
V
CK
17
13
5
2
1
4
14
15
18

DEVICE FOR A HYDRAULICALLY DRIVEN PERCUSSION HAMMER

The present invention relates to a device for a hydraulically driven percussion hammer for activating a tool, especially intended as a drilling hammer. Most percussion hammers are pneumatic, i.e. they are driven by compressed air. This operational form has some obvious disadvantages, so that there has been considerable interest in other operational forms e.g. hydraulic operation. The disadvantages in pneumatic percussion tools consist in their requiring large quantities of air to get sufficient energy. This again requires large pipes. Another disadvantage is that the air-pipes easily freeze and both the compresser and the percussion tools are very noisy. The noise from percussion tools comes partly from the used air which is sudden expansion is emitted from the tool's exhaust port.

A number of different types of hydraulically driven percussion hammers have been proposed, and some have also been used in practice. The great disadvantage common to the previously known percussion hammers of this kind is that great amounts of compressed liquid must be used, necessitating large pumps and sizable pipes, in order to obtain sufficient effect.

Hydraulic drilling hammers are also known which comprise a differential piston where the pressure medium is admitted to the small piston by percussion. Less pressure medium is needed with these percussion hammers, but the blow is ineffective for there is too little pressure as the pressure sinks rapidly with the rapid expansion when the striking piston is displaced in the direction of the stroke.

Devices are known in addition which are equipped with an accumulator or air tank which is loaded by a pressure medium to high pressure and which provides for admission by impact. The machines known of until now are however, very complicated and expensive, and large admission surfaces on the percussion piston are used, so that the impact is ineffective.

The purpose of the present invention is to eliminate the disadvantages mentioned above and to provide a hydraulically driven hammer for activating tools, e.g. a drill, which comprises a differential piston with corresponding cylinder, where the largest operational surface of the piston lies nearest the percussion tool and where the least operational surface is in direct hydraulic connection with an air tank, and the characteristic of the invention is that the largest working surface over a multiple valve is in contact with a hydraulic pressure medium, which valve is adjustable from an admission position with blocked return duct to a position where the admission is blocked and the return is open, and that the piston space over the piston's small working surface has a supply duct with back pressure valve for hydraulic pressure medium .

The hammer according to the invention is simple in its construction and applies very great force in the stroke movement.

In a preferred embodiment, the air tank consists of a cylinder with a membrane or a loose piston. The air tank can in a manner known per se have an over pressure at maximum expansion.

The invention shall as follows be explained more in detail with reference to the drawing which shows an axial cross-section through an embodiment for the invention.

The device consists of a differential piston with 3 unequal diameters. These are marked 1–2 and 3, and can have a forward and backward movement in the corresponding cylinders 4–5 and 6.

The left side will hereafter be called the under side and the right, the upper side. Above the piston part which is marked 3 is a gas-filled or spring-loaded accumulator of a known type 7, here depicted with a piston 8 to separate gas and oil.

A duct for compressed oil 9 with a springloaded back pressure valve 10 opens out into the chamber 11. This room is at the same time a working cylinder for that part of the striking piston which is marked 3.

The compressed oil goes further through the pipe 12 to a valve 13 which can be a rotating valve, kick valve or slide valve of a known type. It can be controlled by a motorized knob or crank, or be rotating. Its purpose is to block the return duct 15 and to lead the compressed oil as well to the under side of the piston part 2 through the duct 14, in connection with the return duct 15. (Shown with dotted line).

A duct 16 with a spring-loaded back pressure valve 17 can emit any possible oil leakage which passes by the piston parts 2 and 3. This oil goes to the return pipe.

The lining for the differential piston consists of pipe-shaped cylinders, 4–5 and 6.

The piston must be fairly long, and both this and the cylinders must be exactly fitted to each other in order to obtain a sealing with at the same time a sliding fit.

It is well known that it is very difficult to join such cylinder parts together without crookedness occuring with accompanying overheating and seizing as a result.

One of the reasons for this is that if these parts are screwed together with collecting bolts, they must be tightened with exactly the same tension. If they are tightened unevenly, the elasticity in the material will cause lob-sidedness and thereby wedging.

If the material is exposed to jolting or blows, tensions may occur which can cause crookedness.

The cylinder head 19 does not lie against the lining 6. This lining is provided with a tightening ring 22. The bore in the sheet metal 18 can have a slightly larger diameter than the outer diameter on the linings. The uppermost lining 6 can have a larger outer diameter than the others, or have a larger diameter uppermost at the tightening ring.

It is assumed that the lining is exactly right-angled, lathed, in relation to inner bores in the latter, which does not constitute any technical difficulties.

The packing between the linings and between the linings and the sheet metal, moreover, can be packing material, gaskets or O-rings as shown in the drawing.

The effect is as follows: The compressed oil comes in through the pipe 9 through the valve 10 and fills the cylinder 11, and as there is an opening between the lining 6 and the cylinder head 19, the oil will bring pressure to bear on the surface of the lining 6 which is not drilled and press all the linings together with a tight connection.

And because there is clearance between the inner diameter on the bore in the block and the outer diameter on the linings, these will find their lie and adjust to the piston even if there should be deviations in direction on the bore in the block.

The effect on the striking mechanism is as follows:

A prototype of the device according to the invention works in the following way: The piston part 3 has an activating surface of 2 $cm^2$ and the ring-shaped piston surface 2 is 4 $cm^2$. The lower end of the piston part 1 lies against a tool (not shown), e.g. a drilling knob, which absorbs the striking energy. It is assumed that the valve 13 is in such a position that the compressed oil is blocked to the duct 14, while the latter is in open connection with the return pipe 15. (Shown on the drawing with a dotted line.) It is similarly assumed that the air tank 7 is filled with a gas pressure of 50 ato and the piston 8 lies against the bottom of the air tank and seals against leakage. The chamber above the piston 8 has a volume of 40 $cm^3$ and the working pressure on the oil is 100 ato.

The compressed oil streams in through the valve 10 and fills up the chamber 11. The piston 8 is then driven upwards to the point where the gas gets a pressure of 100 ato. The volume in the chamber above the piston 8 is then 20 $cm^3$. Any possible leakage oil will be filled again through valve 10.

The oil exerts now a standing axial force of almost 200 kp. on the end surface of the piston 3. The valve 13 is turned now in such a way that the return duct is blocked and the compressed oil comes into the duct 14 and under the ring piston 2. As the working surface on this piston is 4 $cm^2$, the piston will be exposed to an axial force of 400 kp. and will move upwards. The back pressure valve 10 is closed and the oil above the piston part 3 is pressed into the accumulator under the piston 8. When the piston has moved 5 cm upwards, the piston part 3 has displaced 10 $cm^3$ oil. The piston has thereby been displaced upward so that the volume in the gas become 10 $cm^3$ and the pressure 200 ato. A balance is thereby achieved between the axial pressure under the piston part 2 and the pressure over the piston part 3 and the piston stops. Now the valve 13 again shuts for the working pressure and sets duct 14 in connection with the return pipe 15. There is now no noticeable resistance under the piston part 2 and the piston goes downward and executes the percussion, after which the process is repeated. The dimensions given are only included as an example, and can be varied within the framework of the invention.

The energy of the stroke can be varied with other dimensions, other pressure conditions, and the length of the stroke can be varied with e.g. greater or lesser volume in the air tank 7. The liquid pressure which is to be constant in the chamber 11 can also come from a separate pressure source. Duct 9 will then not be connected with duct 12 but with another possible pressure source. By varying this pressure the length of stroke can be varied as desired without changing the size of the air tank 7 or changing the gas pressure in the latter. There is a constant pressure in the duct 12.

By means of the device according to the invention, a hydraulically driven percussion hammer is obtained for activating a tool, which operates with very small amounts of oil and where the stroke energy within wide limits can be adjusted according to need. The hammer can be made small and light and will be very silent in operation.

Having described my invention, I claim:

1. An hydraulically driven percussion device for actuating a tool, comprising means defining a cavity having first, second and third coaxial cylindrical regions of which the first and second regions are of smaller diameter than the third region, a differential piston having first and second end portions and an intermediate portion fitted slidingly in the first, second and third regions respectively of the cavity, the first end portion having two ends, one of which is further from the second end portion than is the other, and the intermediate portion having two end surfaces, one of which is further from the first end portion and gains the intermediate portion to the second end portion and the other of which is further from the second end portion and gains the intermediate portion to the first end portion, the piston having two working surfaces of which a first is constituted by said one end of the first end portion and of which the second is constituted by said one end surface of the intermediate portion, the area of the second working surface being greater than the area of the first working surface, means defining a cylinder which is coaxial with the three coaxial cylindrical regions of said cavity and has one end in direct communication with said first region of the cavity, a second piston fitted slidingly in said cylinder, resiliently compressible means effective on said second piston to urge said second piston toward said one end of said cylinder source means for supplying hydraulic fluid under pressure, first duct means for placing said source means in communication with said first region of the cavity whereby the resiliently compressible means are placed in hydraulic pressure-transmitting relationship with said first working surface, a check valve for preventing flow of hydraulic fluid from said first region towards said source means, second duct means for placing said source means in communication with the second working surface, and a multiple way valve defining a discharge outlet and having a first position in which the source means communicate with the second working surface via said second duct means and both the source means and the second duct means are shut off from the discharge outlet and a second position in which the source means are shut off from the second working surface and the second duct means communicate with said discharge outlet.

2. A percussion device as claimed in claim 1, wherein said source means are operative to maintain a constant pressure in said first duct means.

3. An hydraulically driven percussion device for actuating a tool, comprising means defining a cavity having first, second and third coaxial cylindrical regions of which the first and second regions are of smaller diameter than the third region, a differential piston having first and second end portions and an intermediate portion fitted slidingly in the first, second and third regions respectively of the cavity, the first end portion having two ends, one of which is further from the second end portion than is the other, and the intermediate portion having two end surfaces, one of which is further from the first end portion and surrounds the second end portion and the other of which is further from the second end portion and surrounds the first end portion, the piston having two working surfaces of which a first is constituted by said one end of the first end portion and of which the second is constituted by said one end surface of the intermediate portion, the area of the second working surface being greater than the area of the first working surface, an air tank positioned above the first region of the cavity and in communication therewith, source means for supplying hydraulic fluid under pressure, first duct means for placing said source means in communication with said first region of the cavity whereby the gas in the cylinder is placed in direct hydraulic pressure-transmitting relationship with said first working surface, a check valve for preventing flow of hydraulic fluid from said first region towards said source means, second duct means for placing said source means in communication with the second working surface, and a multiple way valve defining a discharge outlet and having a first position in which the source means communicate with the second working surface via said second duct means and both the source means and the second duct means are shut off from the discharge outlet and a second position in which the source means are shut off from the second working surface and the second duct means communicate with said discharge outlet.

4. A percussion device as claimed in claim 3, wherein the source means are operative to maintain a constant pressure of hydraulic fluid in said first region of the cavity.

* * * * *